US007811030B2

(12) United States Patent
Bussey, Jr. et al.

(10) Patent No.: US 7,811,030 B2
(45) **Date of Patent: *Oct. 12, 2010**

(54) WATER DRAINAGE SYSTEM FOR A FIELD HAVING A WATER IMPERMEABLE LAYER

(75) Inventors: Harry Bussey, Jr., Marco Island, FL (US); Buddy Harry Bussey, III, Atlantic Highlands, NJ (US)

(73) Assignee: ICC Technologies Inc., Marlboro, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/459,549

(22) Filed: Jul. 2, 2009

(65) Prior Publication Data

US 2009/0269137 A1 Oct. 29, 2009

Related U.S. Application Data

(60) Division of application No. 11/711,511, filed on Feb. 27, 2007, now abandoned, which is a continuation-in-part of application No. 11/591,420, filed on Nov. 2, 2006, and a continuation-in-part of application No. 11/637,534, filed on Dec. 12, 2006, now Pat. No. 7,475,477.

(51) Int. Cl.
*E02B 11/00* (2006.01)

(52) U.S. Cl. ..... 405/43

(58) Field of Classification Search ..... 405/43, 405/44, 50

See application file for complete search history.

(56) References Cited

U.S. PATENT DOCUMENTS

| | | | | |
|---|---|---|---|---|
| 3,060,693 | A * | 10/1962 | Taylor | 405/43 |
| 3,396,541 | A * | 8/1968 | Lamberton | 405/50 |
| 4,881,846 | A * | 11/1989 | Burkstaller | 405/37 |
| 5,015,123 | A * | 5/1991 | Houck et al. | 405/45 |
| 6,461,078 | B1 * | 10/2002 | Presby | 405/49 |
| 6,679,653 | B1 * | 1/2004 | DiTullio | 405/49 |
| 2003/0228194 | A1 * | 12/2003 | Ring et al. | 405/46 |
| 2004/0057797 | A1 * | 3/2004 | Ring | 405/46 |

FOREIGN PATENT DOCUMENTS

JP 04198513 A * 7/1992

* cited by examiner

*Primary Examiner*—John Kreck
(74) *Attorney, Agent, or Firm*—Francis C. Hand; Carella, Byrne, Cecchi

(57) ABSTRACT

The tubular element is made with a sleeve formed of a spun bonded polyester material that allows the passage of water and prevents the passage of soil when used for a drainage element. The tubular element is made with small diameters that allows the element to be coiled about a three-dimensional object when used as a cushioning device.

7 Claims, 3 Drawing Sheets

WATER DRAINAGE SYSTEM FOR A FIELD HAVING A WATER IMPERMEABLE LAYER

This is a Division of U.S. Ser. No. 11/711,511, filed Feb. 27, 2007 now abandoned, which is a Continuation-in-Part of U.S. Ser. No. 11/591,420, filed Nov. 2, 2006 and a Continuation-in-Part of U.S. Ser. No. 11/637,534, filed Dec. 12, 2006, now U.S. Pat. No. 7,475,477.

This invention relates to a tubular element with a light weight aggregate filling.

As described in the parent applications, drainage elements have been constructed of loose aggregate, such as foam plastic elements, beads, and other light weight materials all encased in a net-like sleeve. In some cases, a perforated plastic pipe has been incorporated in the drainage element.

Also, as described in co-pending patent application U.S. Ser. No. 11/591,420, filed Nov. 2, 2006, use is made of a membrane to encase a mass of light weight aggregate to form a drainage element that allows water to pass through but prevents the passage of soil particles into the aggregate.

As described in co-pending patent application U.S. Ser. No. 11/637,534, the drainage elements may be used in a horizontal disposition in a trench or the like as well as in a vertical disposition. For example, where a field, such as a golf course, or ball playing field, accumulates water after a rainstorm in a pond-like manner due to an almost impervious layer of soil at that location, the drainage elements may be used to drain the water. In such cases, a plurality of vertically disposed holes are drilled or otherwise formed through the impervious layer to a more water pervious layer, the drainage elements are placed vertically in the holes and a suitable backfill placed over the drainage elements to close the holes. Accumulated water can then drain downwardly through the drainage elements to the more water pervious layer to be drained away.

As is described in U.S. Pat. No. 4,689,145, dry wells for rain water run off have been comprised of four foot diameter cylindrical excavations filled with washed gravel to depths of up to 75 feet with the washed gravel comprised of stones of from % inch to 1.5 inch diameter. Further, as described, one of the problems of these dry wells is that sand and silt washed from the areas being drained relatively quickly clogs the gravel thereby requiring that another dry well be drilled.

Accordingly, it is an object of this invention to provide a tubular element with light weight aggregate that can be used as a drainage element in a vertical manner for the drainage of a pond or the like and that has an increased capacity to draw off water.

It is another object of the invention to provide a tubular element with light weight aggregate within a membrane that can be used as a cushioning device.

It is another object of the invention to provide a tubular element of light weight for use in constructing a dry well.

Briefly, the invention provides a tubular element that is comprised of a mass of light weight discrete thermoplastic aggregate and a sleeve encasing the mass of discrete aggregate.

In one embodiment of the invention, the tubular element is characterized in having a predetermined outer diameter (D) and a length (L) to diameter (D) ratio of from at least 30 to 1 and in being sufficiently flexible over the length thereof to coil about a three-dimensional object. In particular, the tubular element has a diameter of from 1 inch to 36 inches and, preferably, a diameter of from 2 inches to 4 inches.

The sleeve is a preferably a membrane having a grab tensile strength of 61/61 lbf as measured under ASTM D-5034 and a grab elongation to break in % of 45/50 as measured under ASTM D-5034, for example, the membrane is made of spun bonded non-woven polyester. The membrane sleeve provides a particularly tough cover for the light weight aggregate that is resistant to tearing while the light weight aggregate can be made of a weight of 1.0 pounds per cubic foot or less to impart a very light weight to the element. The sleeve may be made of a netting or may be made as a composite sleeve that is half netting and half membrane, circumferentially speaking, and the membrane may be paper.

The tubular element is useful as a cushioning device, and particularly for the wrapping of one or more three-dimensional objects. For example, at least one tubular element can first be coiled about an object and then a layer of shrink-wrap can be enveloped about the object and tubular element to form a tight cushioned package for shipping purposes. The light weight of the tubular element is particularly advantageous for the shipping of objects since little weight is added to the packaging of the object being shipped. Further, the size of the tubular element can be suited to the object being shipped to provide more or less of a cushion against impacts on the packaged object.

In another embodiment, the tubular element may be employed in a water drainage system, particularly in environments where water collects in a depressed area in which the underlying soil has a layer of clay or the like that is impervious to the passage of water.

The invention permits a trench to be formed in the soil down to the impervious layer and in which a plurality of horizontally disposed drainage elements may be subsequently disposed in a linear array. In addition, a series of vertical holes may be drilled from the bottom of the trench through the impervious layer to a lower water-permeable sub-soil layer, for example, using an auger. Thereafter, a tubular element can be placed in each vertical hole and the horizontal drainage elements placed in the trench in communication with each other so that water draining from the horizontal elements flows into and down the vertical elements.

Where the water-pervious layer below the impermeable layer of soil is not readily permeable, each vertically disposed drainage element may include a perforated pipe that extends vertically within the mass of aggregate for accumulating water within the pipe, for example after a rainstorm. Thus, each pipe acts as a reservoir to drain the water the exposed ground area and to hold the water for gradual seepage out of the drainage element into the surrounding sub-soil.

This drainage system may use drainage elements of different construction. For example, the sleeve of each horizontally disposed drainage element includes an upper peripheral portion of a water-permeable filter material for the passage of water therethrough and the filtering of fine particles of solid material from the water passing through the material and a lower peripheral portion of net material having openings for retaining the aggregate and allowing the passage of water. The sleeve of each vertically disposed drainage element may be completely of net material similar to the net material of the horizontally disposed drainage element.

The tubular element of the invention may be sized to be used individually or in bundles for use in a dry well situation. For example, after drilling a hole in the area to be drained, a tubular element sized to the diameter of the hole can be dropped into the hole and covered over to form a dry well. For large depths, a series of tubular elements may be placed in the hole. Since, the tubular elements are of light weight, they can be easily handled by one person as compared with the filling of the hole with gravel. Also, one or more bundles of parallel tubular elements can be dropped into the hole where the hole is of a large diameter.

These and other objects and advantages of the invention will become more apparent from the following description taken in conjunction with the accompanying drawings wherein.

Figure 1:
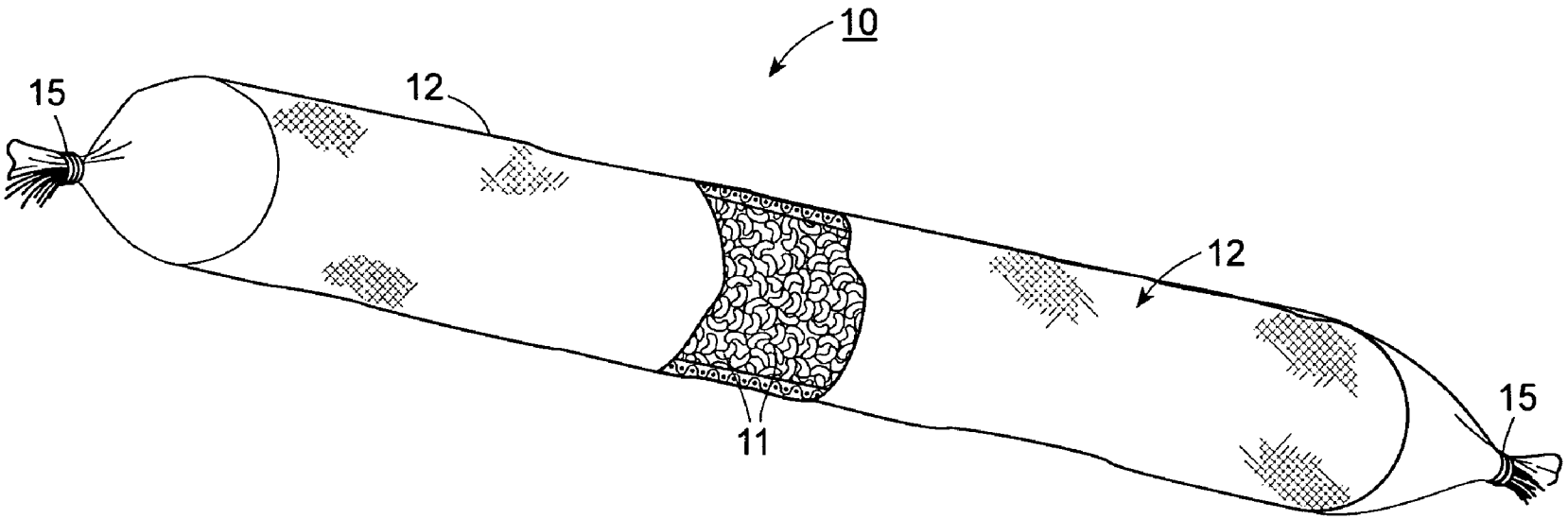
FIG. 1 illustrates a perspective view of a tubular element in accordance with the invention.

Referring to FIG. 1, the tubular element 10 is formed of a mass 11 of discrete lightweight aggregate, such as loose fill thermoplastic elements, that define passageways for a flow of fluid therethrough and a sleeve 12 that encases the mass of aggregate 11. The tubular element 10 is made in a manner as described in the parent applications, the specifications of which are incorporated by reference herein.

Each end of the tubular element 10 is closed by means of a tie 15 that closes around a gathered end of the sleeve 12 to retain the aggregate in place. Each tie 15 may be in the form of a conventional tie for holding the gathered ends of the sleeve 12 together.

The membrane 12 is made of a spun bonded non-woven polyester having a grab tensile strength of 61/61 pounds per foot (lbf) as measured under ASTM Stand D-5034 as well as a grab elongation to break in percentage (%) of 45/50 as measured under ASTM Standard D-5034. Any other suitable type of membrane material may also be used provided it has sufficient tear strength and the permeability of the membrane 12.

Figure 2:
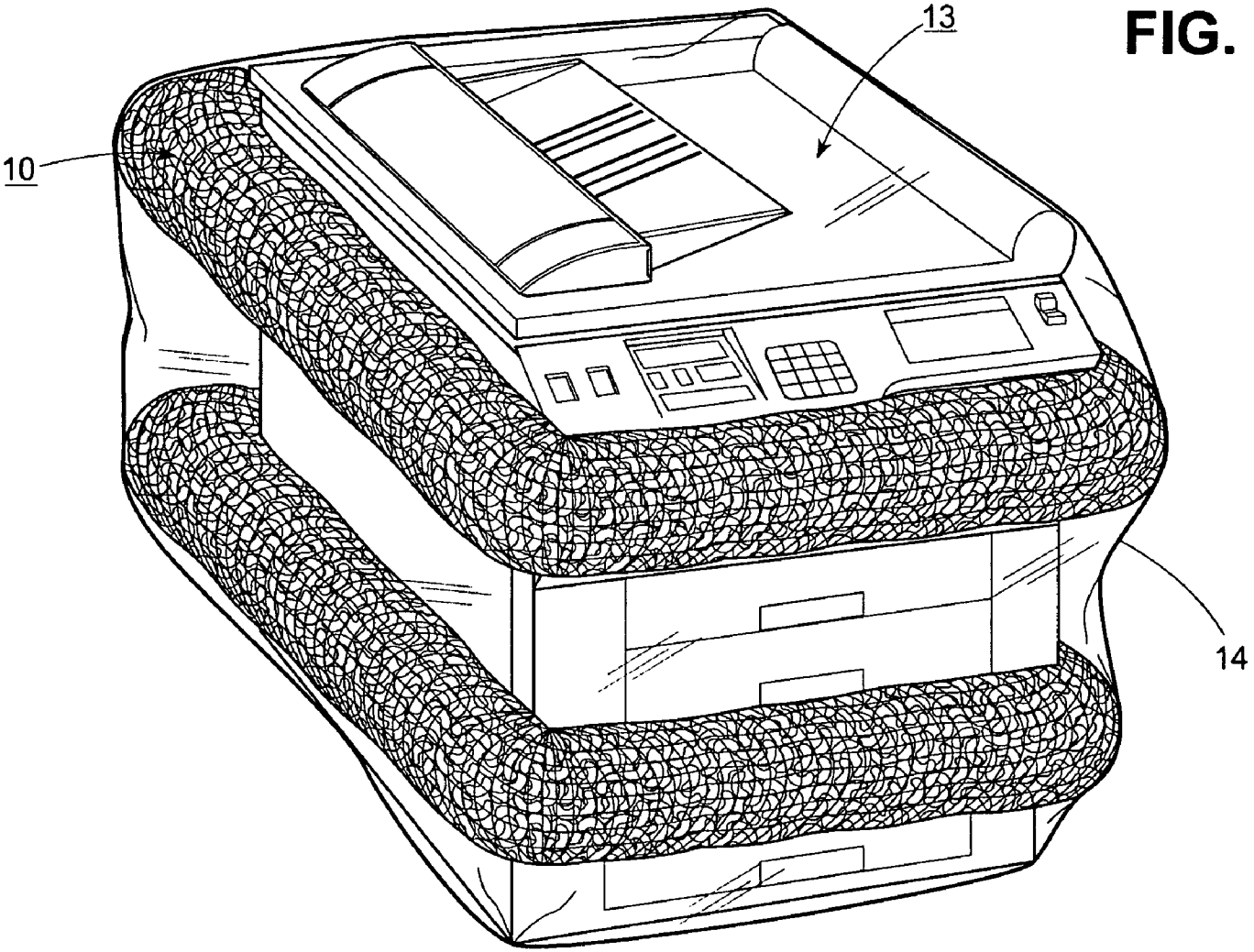
FIG. 2 illustrates a perspective view of the tubular element of FIG. 1 wrapped about a three-dimensional object.

Referring to FIG. 2, in order to use the tubular element 10 as a cushioning device, the tubular element 10 is coiled about a three-dimensional object 13 and then a layer of shrink-wrap 14 is enveloped about the object 13 and tubular element 10 to form a tight cushioned package for shipping purposes.

The tubular element 10 is characterized in being sufficiently flexible and slender over the length thereof to coil about the three-dimensional object 13 without breaking or cracking. For example, the slenderness ratio of the length (L) of the element to the diameter (D) of the element is from at least 30 to 1. In particular, the tubular element has a diameter of from 1 inch to 36 inches and preferably a diameter of from 2 inches to 4 inches.

Figure 3:
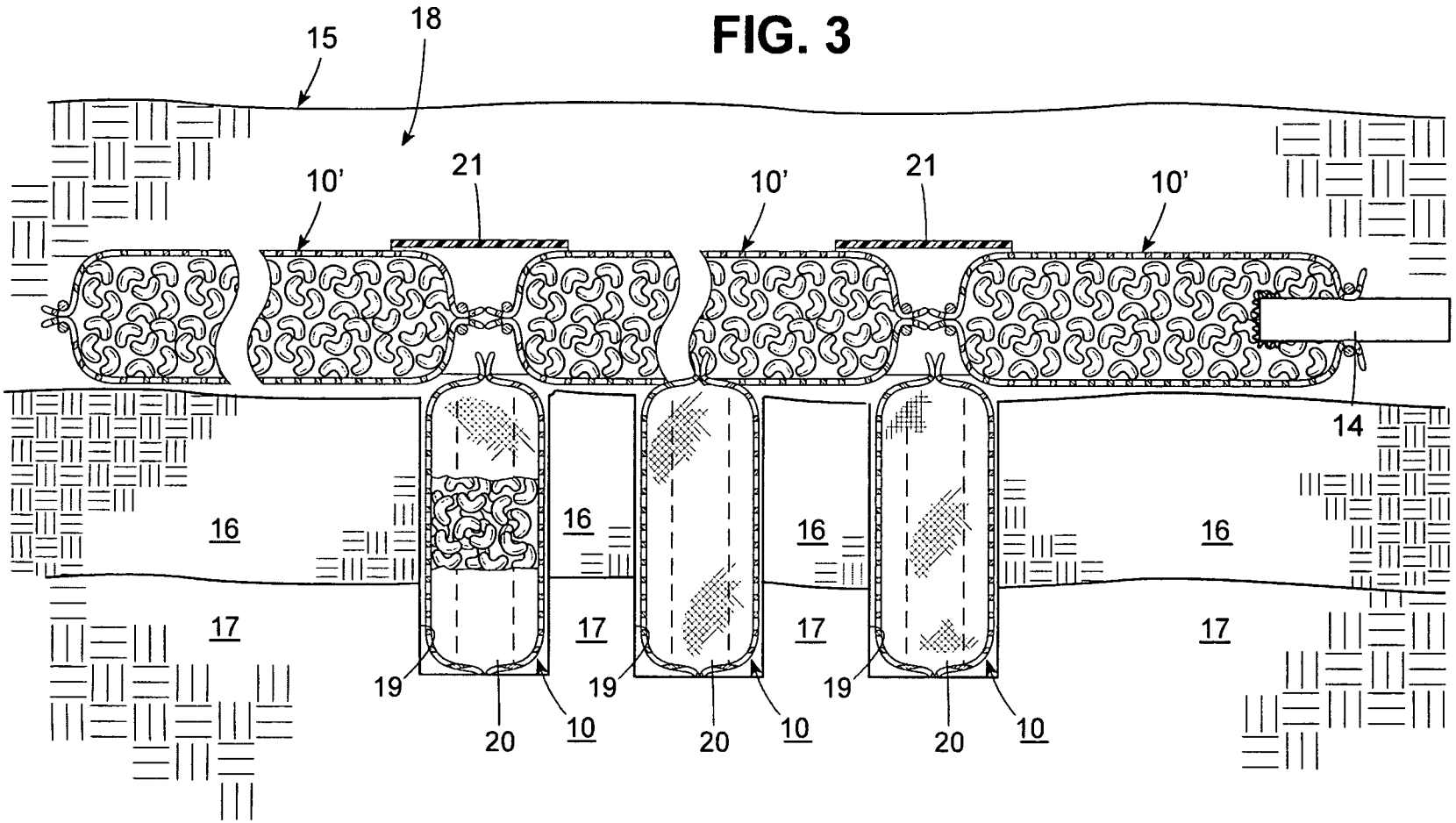
FIG. 3 illustrates a partial view of a water drainage system employing the drainage elements of the invention.

Referring to FIG. 3, the elements 10 are particularly useful in a water drainage system for draining a field 15, such as a golf course, or ball playing field, that accumulates water after a rainstorm in a pond-like manner and where there is an underlying layer of clay or other water-impermeable layer 16 and a further water-permeable layer of sub-soil 17 beneath the water-impermeable layer 16.

For example, a trench 18 is first formed in the field 15 down to the water-impermeable layer 16. Thereafter, a series of vertical holes 19 or at least holes that are directed downwardly are drilled, for example, using an auger, that are of a length to pass through the water-impermeable layer 16 into the water-permeable layer 17.

Next, a tubular element 10 of sufficient diameter and length is placed in each vertical hole 19. Thereafter, a series of elements 10' of suitable diameter and length are placed in linear alignment in the trench 18. Each of these elements 10' is made as described in the parent application with a net side and a membrane side and are placed in the trench 18 with the net side of each element placed down and with the membrane side placed up. The horizontally disposed elements 10' are disposed in communication with the vertical elements 10 so that water may drain through the horizontal elements 10' down into the vertical elements 10 so that the water may be delivered into the sub-soil layer 17.

In these cases also, the vertically disposed drainage elements 10 may be fabricated, as above, with a membrane material 12 completely or only partially enveloping the loose fill aggregate 11 or may be fabricated with a net completely enveloping the loose fill aggregate.

After the drainage elements 10' are placed in the trench 18, backfill material is deposited into the trench 18 to cover over the drainage elements 10'. Since the membrane material only permits water to pass through, the soil from the backfill material is prevented from passing into the drainage elements 10'.

The lowermost drainage element 10' in the series may also be connected via a suitable coupling to a lateral pipe (not shown) that, in turn, connects to a storm sewer pipe so that the water collected by the drainage elements 10 can flow under gravity from drainage element 10' to drainage element 10' and then to the pipes.

In cases where there are no storm sewerpipes, the horizontally disposed drainage elements 10' may be used to collect water from the field 15 for delivery into the vertically disposed drainage elements 10 for dissipation into the water-permeable sub-soil layer 17 to be drained away.

In some cases, particularly where the sub-soil layer 17 is only slowly water-permeable, each vertical drainage element 10 may be provided with a perforated pipe 20 that extends entirely through the drainage element 10 or not, as described in the above-noted copending parent patent application. In this case, the perforated pipe 20 receives water from the horizontally disposed drainage elements 10', in the manner of a reservoir, and holds the water for dissipation through the aggregate of the vertically disposed drainage element 10 into the sub-soil 17 over time. By changing the diameter of the pipe 20, the capacity of a drainage element 10 to hold water may be increased or decreased.

As illustrated, a strip 21 of the membrane material is bridged over the ends of two adjacent horizontally disposed drainage elements 10' and secured in place by an adhesive or other suitable securing means (not shown). This strip 21 serves to prevent fine particles from passing into the space between the two adjacent drainage elements 10' while allowing water to pass through.

Alternatively, any other type of cover to prevent the passage of soil may be used in place of the strip 21. For example, a rigid U-shaped cover of solid material may be used.

The tear resistant nature of the membrane material allows the drainage element 10 to be roughly handled when being placed in a trench 18 in the field. This, in turn, reduces the risk that the membrane might be punctured or otherwise compromised by shovels or like equipment used to spread the backfill material over the drainage element 10.

The arrangement of horizontally disposed and vertically disposed drainage elements may also be used for septic systems. In such cases, the horizontally disposed drainage elements are used to carry water from a sump or the like outwardly to where the vertically disposed drainage elements are located. These horizontally disposed elements may also be fabricated with the bottom circumferential half made of netting to allow effluent to flow through the netting into the soil beneath the elements while the top circumferential half is made of mambrane to preclude soil or other fines from entering into the elements. Further, the vertically disposed elements may be arranged to extend laterally outwardly of the horizontal drainage elements at downwardly directed angles and from opposite sides of the horizontal drainage elements in order to direct effluent into the sub-soil layer 17.

The use of vertically disposed drainage elements in a septic system allows the overall volume of soil into which the septic system drains to be increased thereby reducing the square footage of land required for the system to be reduced. For example, where a septic system with only the above horizontal drainage elements may require a 1000 square foot area for draining, a septic system having the added vertically disposed drainage elements may require only a 600 square foot area.

The tubular element 10 may also be used to form a dry well by being placed vertically in a hole in the ground (not shown) without need of the usual stones and/or sand layer used to make dry wells. Where the hole for the dry well is particularly deep, a series of tubular elements 10 may be placed one over the other in the hole. Where a particularly large capacity is required of the dry well, one or more bundles of the tubular elements may be formed in parallel and used to make the dry well. Also, to increase the capacity, the tubular element or elements may be provided with a perforated pipe, as described above, that extends entirely through a tubular element to connect with an adjacent element or conduit or that extends only within the tubular element with a screen or the like over the end of the pipe to prevent ingress of the aggregate.

What is claimed:

1. In a water drainage system for a field having a water-impermeable layer and an underlying water-permeable layer beneath said water-impermeable layer, the combination of a plurality of horizontally disposed drainage elements disposed in a linear array within a layer of soil above said water-impermeable layer, each said drainage element having a mass of light weight discrete aggregate defining passageways for a flow of water therethrough and a sleeve encasing said mass of discrete aggregate; and a plurality of vertically disposed drainage elements below said horizontally disposed drainage elements for receiving flows of water therefrom and passing through said water-impermeable layer into said water-permeable layer to dissipate the flows of water into said water-permeable layer, each said vertically disposed drainage element having a mass of light weight discrete aggregate defining passageways for a flow of water therethrough and a sleeve encasing said mass of discrete aggregate.

2. A water drainage system as set forth in claim 1 further comprising a plurality of strips of filter material, each said strip bridging over a respective pair of said horizontally disposed drainage elements, each said strip having a plurality of interstices characterized in being of a size for the passage of water therethrough and the filtering of fine particles of solid material from the water passing through said strip.

3. A water drainage system as set forth in claim 1 wherein said sleeve of each said horizontally disposed drainage element includes an upper peripheral portion of a water-permeable filter material for the passage of water therethrough and the filtering of fine particles of solid material from the water passing through said material and a lower peripheral portion of net material having openings for retaining said aggregate and allowing the passage of water.

4. A water drainage system as set forth in claim 1 wherein each said vertically disposed drainage element includes a perforated pipe extending vertically within said mass of aggregate for receiving and accumulating water from a respective horizontally disposed drainage element therein.

5. A water drainage system as set forth in claim 4 wherein at least one end of said pipe is disposed within said mass of aggregate and a screen is disposed over said one end of said pipe within said mass of aggregate for blocking entry of said aggregate into said pipe.

6. A septic system for a field having a water-impermeable layer and an underlying water-permeable layer beneath said water-impermeable layer, the combination of a plurality of horizontally disposed drainage elements disposed in a linear array within a layer of soil above said water-impermeable layer, each said drainage element having a mass of light weight discrete aggregate defining passageways for a flow of effluent therethrough and a sleeve encasing said mass of discrete aggregate; and a plurality of vertically disposed drainage elements extending laterally outward from and below said horizontally disposed drainage elements for receiving flows of effluent therefrom and passing through said water-impermeable layer into said water-permeable layer to dissipate the flows of effluent into said water-permeable layer, each said vertically disposed drainage element having a mass of light weight discrete aggregate defining passageways for a flow of effluent therethrough and a sleeve encasing said mass of discrete aggregate.

7. A septic system as set forth in claim 6 wherein said sleeve of each said horizontally disposed drainage element includes an upper peripheral portion of a membrane to preclude soil from passing therethrough into said aggregate thereof and a lower peripheral portion of net material having openings for retaining said aggregate and allowing the passage of effluent.

* * * * *